US009297582B2

(12) United States Patent
Crawford

(10) Patent No.: US 9,297,582 B2
(45) Date of Patent: Mar. 29, 2016

(54) METHOD TO ACTIVELY CONTROL STEAM VELOCITY

(71) Applicant: Jonathan Crawford, Burnaby (CA)

(72) Inventor: Jonathan Crawford, Burnaby (CA)

(73) Assignee: Honeywell ASCa Inc., Mississauga (CA)

( * ) Notice: Subject to any disclaimer, the term of this patent is extended or adjusted under 35 U.S.C. 154(b) by 513 days.

(21) Appl. No.: 13/865,154

(22) Filed: Apr. 17, 2013

(65) Prior Publication Data

US 2014/0310978 A1 Oct. 23, 2014

(51) Int. Cl.

| | |
|---|---|
| ***D21F 7/12*** | (2006.01) |
| ***F26B 21/00*** | (2006.01) |
| ***D21F 7/00*** | (2006.01) |
| ***D21G 7/00*** | (2006.01) |
| ***F26B 3/02*** | (2006.01) |

(52) U.S. Cl.

CPC ..... *F26B 21/004* (2013.01); *D21F 7/008* (2013.01); *D21G 7/00* (2013.01); *F26B 3/02* (2013.01)

(58) Field of Classification Search

None

See application file for complete search history.

(56) References Cited

U.S. PATENT DOCUMENTS

| | | | | |
|---|---|---|---|---|
| 4,981,164 | A | 1/1991 | Reichel | |
| 5,161,682 | A | 11/1992 | Seifert | |
| 6,216,398 | B1 | 4/2001 | Shipman | |
| 6,264,795 | B1 * | 7/2001 | Hamel | D21G 1/0093 100/38 |
| 7,146,238 | B2 * | 12/2006 | Burma | D21F 1/06 162/252 |
| 7,213,632 | B1 | 5/2007 | Goldstein | |
| 7,459,061 | B2 | 12/2008 | Passiniemi | |
| 7,513,975 | B2 * | 4/2009 | Burma | D21F 1/06 162/252 |
| 7,871,494 | B2 | 1/2011 | Viaser | |
| 9,145,644 | B2 * | 9/2015 | Crawford | D21F 7/008 |

FOREIGN PATENT DOCUMENTS

| | | | |
|---|---|---|---|
| CA | 2185889 | * | 1/1995 |
| WO | 2005003454 A2 | | 1/2005 |

* cited by examiner

*Primary Examiner* — Mark Halpern

(74) *Attorney, Agent, or Firm* — Charles H. Jew

(57) ABSTRACT

A steam distributor includes a front screen equipped with steam perforations wherein the output area of at least some of the perforations can be adjusted to enable active control of the steam jet velocity. The steam velocity can be controlled independently of steam flow. The front screen is includes (i) a first plate that has a first set of apertures and (ii) a second plate that has a second set of apertures, wherein the second plate covers the first plate, and wherein the means fir varying the size of at least one of the perforations moves the first plate, the second plate, or both the first and the second plates in order to change the position of the first set of apertures relative to the second set of apertures.

20 Claims, 4 Drawing Sheets

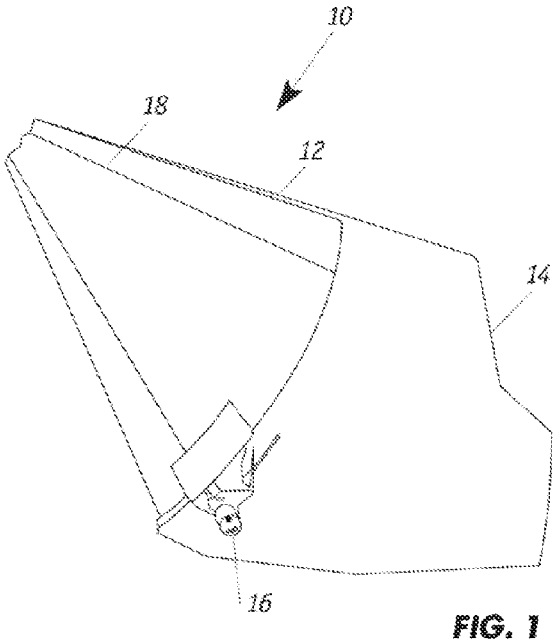
FIG. 1
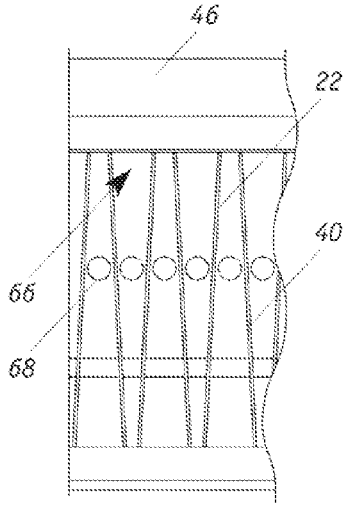
FIG. 2C
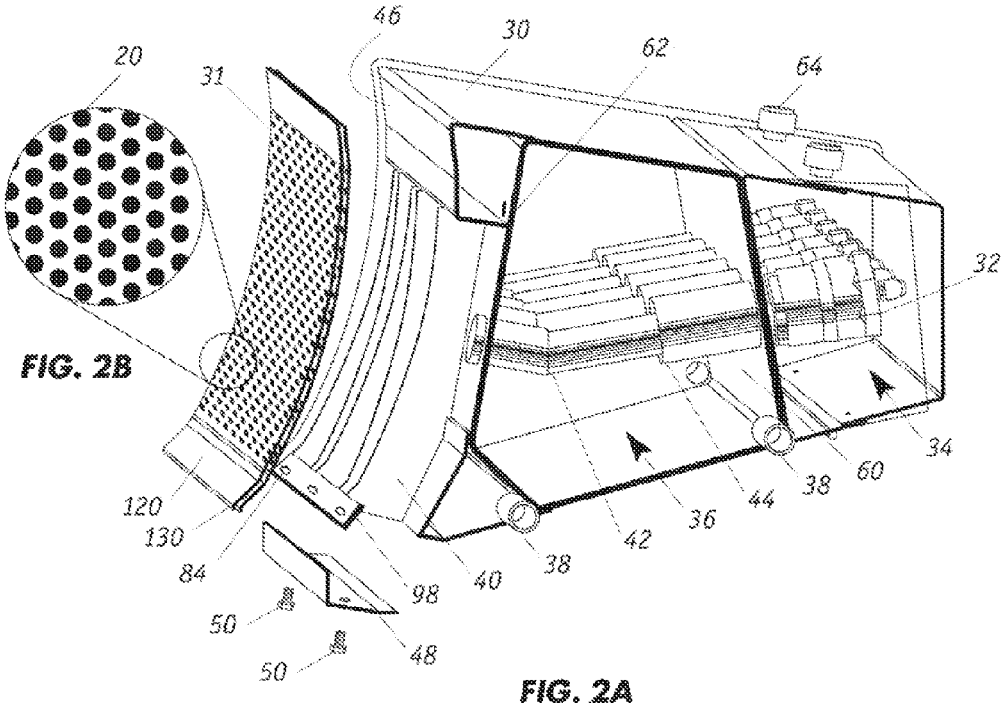
FIG. 2B
FIG. 2A

METHOD TO ACTIVELY CONTROL STEAM VELOCITY

FIELD OF THE INVENTION

The present invention generally relates to a steam distributor for applying steam to a web such as a paper sheet that is moving along its side wherein steam is discharged through a plurality of perforations in a screen. By varying the output area of the perforations, optimal steam velocity can be attained to achieve the desired steam absorption into the web and/or achieve efficient moisture removal.

BACKGROUND OF THE INVENTION

The steam heating of a paper sheet is widely practiced in papermaking. The increase in sheet temperature that results provides increased drainage rates for the water thus reducing the amount of water to be evaporated in the drier section. Water drainage is improved by the application of steam principally because heating of the sheet reduces the viscosity of the water, thus increasing the ability of the water to flow. Most of the heat transfer takes place when the steam condenses in the sheet. The condensation of the steam transforms the latent heat of the steam to sensible heat in the water contained by the sheet.

A particular advantage of steam heating of the paper sheet is that the amount of steam applied may be varied across the width of the sheet along the cross machine direction so that the cross machine moisture profile of the sheet may be modified. This is usually carried out to ensure that the moisture profile at the reel is uniform. Moisture measurement devices are well known in the papermaking art that can sense the moisture profile of a sheet of paper. If such an apparatus is scanned over the paper sheet, downstream of a steam distributor, then after measuring the water profile in the sheet, steam can be applied in varying amounts on a selective basis across the sheet, thus achieving the required uniform moisture profile at the reel.

A typical steam distributor is divided into compartments with laterally spaced-apart baffle plates that are covered with a partially perforated cover. Actuators supply steam to the compartments. By regulating the supply of steam into each compartment, it was possible to a limited extent to control the moisture profile of the sheet. Nevertheless, even with these improvements, the velocity of the steam passing through the perforated cover varies only with the actuator flow rates so ideal steam velocity cannot be achieved for different flow rates.

SUMMARY OF THE INVENTION

The present invention is based in part on the development of a steam distributor that includes a front screen that is equipped with steam perforations wherein the output area of at least some of the perforations can be adjusted to enable active control of the steam jet velocity. With respect to paper manufacturing, steam velocity affects penetration depth, boundary layer penetration, and response shape, especially the response width of the steam that is applied to the sheet. Excessive steam velocity causes sheet breakage whereas slowly delivered steam yields poor efficiency. With the present invention, the steam velocity can be controlled independently of steam flow to optimize efficiency and thereby avoid sheet upsets.

Accordingly, in one aspect, the invention is directed to an apparatus to distribute steam that includes:

a steam distribution header;

a housing defining a steam discharge chamber that is in fluid communication with the steam distribution header;

a front screen that covers the steam discharge chamber and which has a plurality of perforations through which steam exits;

means for varying the size of at least one of the perforations through which steam exits; and means for regulating the flow of steam from the steam distribution header into the steam discharge chamber.

In another aspect, the invention is directed to a method of distributing steam along a length of continuously moving sheet which includes the steps of:

(a) positioning an apparatus having a leading edge and a trailing edge relative to the moving sheet, wherein the apparatus includes:

(i) a steam distribution header;

(ii) a housing defining a steam discharge chamber that is in fluid communication with the steam distribution header; and (iii) a front screen that covers the steam discharge chamber and which has a plurality of perforations through which jets of steam exit;

(b) regulating the flow of steam from the steam distribution header into the steam discharge chamber to establish a predetermined, steam flow rate through the plurality of perforations;

(c) adjusting the velocities of the Jets of steam to desired levels at the predetermined steam flow rate.

BRIEF DESCRIPTION OF THE DRAWINGS

FIG. 1 is a perspective view of a steam distribution apparatus;

FIG. 2A is a perspective view of the compartments in the steam distributor apparatus;

FIG. 2B is enlarged, partial view of the front screen panel;

FIG. 2C is a partial front view of the compartments formed by stationary baffles or dividers;

FIG. 7B illustrates an actuator.

DETAILED DESCRIPTION OF THE PREFERRED EMBODIMENTS

Figure 3:
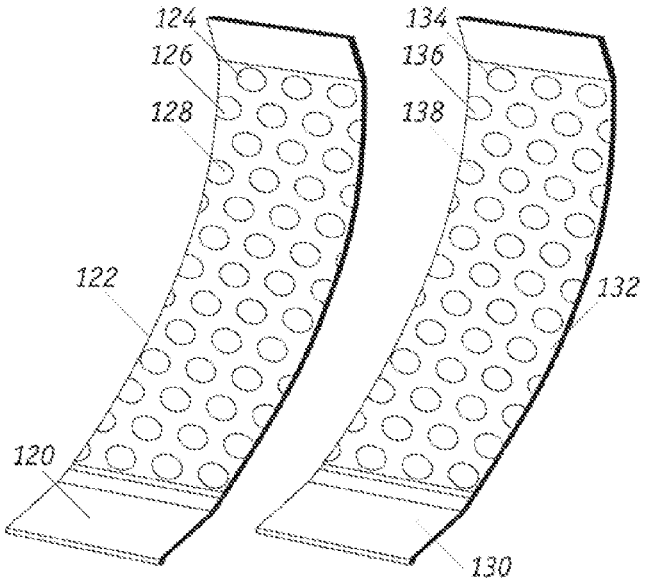
FIG. 3 shows a pair of separated plates that form a front screen when they are combined.

FIG. 1 illustrates the overall assembly of a steam distribution apparatus or steam box 10 which includes an elongated housing 12 that is enclosed by end plates located at opposite ends. The length of the apparatus typically corresponds to the width of the sheet or web to which steam is to be applied. For papermaking operations the length can range, for instance, up to about 30 feet (9.1 meters). An external source of steam is connected to the steam distribution apparatus 10 and excess steam in the form of condensate is removed through a drain 16 which is located on the side of end plate 14. The contour of the front screen panel or plate 18 preferably matches the external shape of the product to which steam is being supplied. The concave-shaped curvature of front screen panel 18 is particularly suited for apply steam to a roll of material. The front screen panel can also have a planar configuration to match the straight run of a moving sheet.

As further described herein, front screen panel 18 has steam outlets or perforations (not shown) that are formed thereon. The perforations are arranged so that exiting steam expands and impacts the surface of adjacent moving sheet to form a desired pattern (or response shape) of condensate. In one embodiment, the response shape is uniform along the width (or cross direction) of the moving sheet. With the present invention, the steam velocity can be optimized independent of the steam how rate.

The steam distributor apparatus 10 is preferably separated into a plurality of steam discharge chambers or compartments along its length. By regulating the amount of steam that passes through each compartment, it is possible to control the level of condensate that is applied along the cross direction of the moving sheet. For example, the amount of steam that enters into the individual chambers can be controlled in response to variations in measured properties of the sheet along its cross direction. Furthermore, the perimeter(s) of one or more of the compartments that define that steam profiling zone for the steam application can also be modified. This permits control of the steam profile along the cross direction as well. The invention is illustrated in an apparatus with multiple steam discharge chambers or compartments. The partitions or baffle panels that are laterally spaced apart create corresponding profiling zones that are covered by a perforated screen plate through which steam passes. It is understood however that the invention can be implemented with a steam distributor having a single discharge chamber.

FIG. 2A shows a partially disassembled exposed portion of the housing 30 of the steam distributor apparatus. The housing 30 encloses a steam distribution header 36 which is connected to at least one source of steam (not shown). Header 36 runs the length of the steam distribution apparatus. The header 36 is flanked by an interior wall 60 and an exterior wall 62. The inner enclosure 34 shields the pneumatic actuators 32 with a removable cover that is secured by the hand tightened screws 64. A plurality of baffles or partition panels 40, that are laterally spaced apart, are secured to the exterior wall 62 thereby creating a number of steam discharge chambers or compartments once the front screen panel segment 31 is secured to the forward part of the housing. As further described herein, screen panel segment 31 comprises an interior plate 130 that is coupled to exterior plate 120 that faces a moving web.

In this embodiment, the middle of front screen segment 31 of front screen panel 18 (FIG. 1) is fully populated with outlets 20, which as shown in FIG. 2B. Outlets 20 are preferably circular but it is understood that the individual outlets can have non-circular configurations. The number and size of the outlets are designed to achieve the desired steam flow rate and velocity. The size of the outlets 20 should be sufficiently small to minimize the amount of fibers and other debris from the sheet of material being heated that enters into the discharge chambers. Nevertheless, in operation, as steam is applied through the perforations 20 onto a moving sheet of paper, for instance, the middle of front screen segment 31 can come into contact with the sheet. In this regard, it is may be preferred to avoid excessive blank areas on the middle of front screen segment since there may be a tendency for debris to accumulate in areas on the panel that are not populated with outlets. As is apparent, the number of front screen panel segments 31 required to cover a steam distribution apparatus will depend on the total cross directional length of the steam distribution apparatus and the cross directional length of each panel segment 31.

Each pneumatic actuator 32 is operatively connected to a pipe 42 which has an inlet end located within the header 36 and an outlet end that is located in a discharge chamber. In this embodiment, the inlet end of the pipe 42 is partially covered by a sleeve 44. A piston is attached to the actuator 32 by a connecting rod to regulate the inlet into pipe 42 and thus control the steam flow between the header 36 and the control chamber.

As shown in FIG. 2C, a plurality of oblique-oriented baffles 40, which are not aligned with the machine direction of movement of the traveling sheet (not shown), form a plurality of steam discharge compartments 66 along the cross direction or width of the steam distribution, apparatus 10 (FIG. 1). While baffles 40 are illustrated as being planar, it understood that they can be curved or other non-planar configuration. The perimeter(s) of discharge compartments 66 define a series of trapezoidal-shaped profiling zones 22 through which steam from outlets 68 passes as it travels toward the steam perforations 20 (FIG. 2B). In this arrangement, adjacent trapezoidal-shaped profiling zones are inverted with respect to each other. The profiling zones 22 can exhibit other shapes depending on the configuration of partition panels 40. Where adjacent panels 40 are vertical and parallel, the profiling zones are rectangular.

FIG. 3 illustrates the front screen 31 (FIG. 1) when dissembled into an exterior plate 120 and an interior plate 130. (Only a few of the perforations in front screen 31 are represented.) The exterior plate 120 has a plurality of apertures 124, 126, 128 that form a pattern of apertures as shown on the front surface 122. Similarly, the interior plate 130 has a plurality of corresponding apertures 134, 136, 138 that form a pattern of apertures as shown on the front surface 132. The dimensions and curvature of exterior plate 120 match that of interior plate 130 so that when the two plates are slidably fitted together, they form front screen 31 (FIG. 1). In this embodiment, the size of the circular apertures in both plates 120 and 130 are the same; moreover, the pattern of the apertures in plate 120 is also aligned with the pattern of the apertures in plate 130. Thus, for example, apertures 124, 126 and 128 of exterior plate 120 are directly above apertures 134, 136 and 138, respectively, when exterior plate 120 and interior plate 130 are assembled to form the front screen 31. The configurations and positions of the apertures in the plates can be varied as desired in order to achieve optimum steam velocities. For example, while the cross sectional area of the apertures is preferably circular the area can be rectangular or other polygonal shape. In the case where the cross sectional area is circular, its diameter typically ranges from 0.0625 to 0.25 inches (1.59 to 6.35 mm) and preferably from 0.0625 to 0.125 in. (1.59 to 3.18 mm). Regardless of the geometry, the cross sectional area of each aperture typically ranges from 0.003 to 0.05 sq. in. (1.94 to 32.3 sq. mm) and preferably from 0.003 to 0.012 sq. in. (1.94 to 7.74 sq. mm.) The thickness of the exterior plate 120 is preferably the same as that of interior plate 130; the thickness of each plate typically range from about 0.0313 to 0.125 in. (0.795 to 3.175 mm) and preferably from about 0.0625 to 0.125 in. (0.795 mm to 3.175 mm).

Figure 4A:
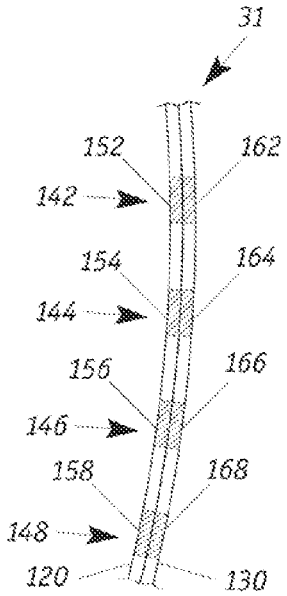
FIG. 4A shows the cross sectional view of a screen consisting of two plates with apertures that are form perforations through which steam flows.
Figure 4B:
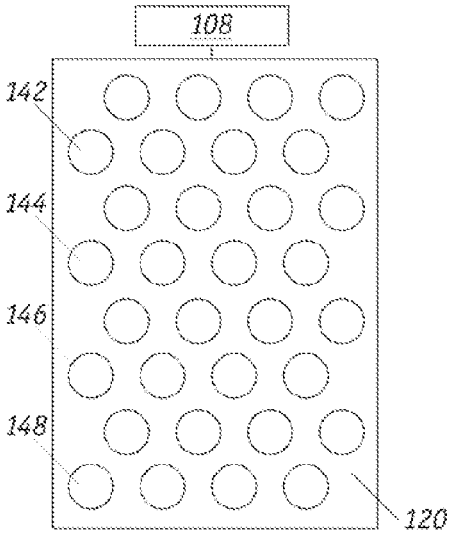
FIGS. 4B and 4C show the front views of the screen consisting of two plates with apertures wherein the apertures are fully and partially aligned, respectively.

FIGS. 4A and 4B depict a partial cross sectional and front view of screen 31 (FIG. 1) that is formed by pressing exterior plate 120 against interior plate 130. The apertures in exterior plate 120 are fully aligned to those of interior plate 130 and, as an illustration, apertures 152, 154, 156 and 158 are located along one side of exterior plate 120 and are aligned with corresponding apertures 162, 164, 166, and 168, respectively on one side of interior plate 130. In this configuration, apertures 152 and 162 form perforation 142, apertures 154 and 164 form perforation 144, apertures 156 and 166 form perforation 146, and apertures 158 and 168 form perforation 148 on screen plate 31. In the fully aligned arrangement shown in FIG. 4B, the output area of the perforation is the highest which means that for a given steam flow rate into a discharge chanter, the steam jet velocity is at the lowest.

Figure 4C:
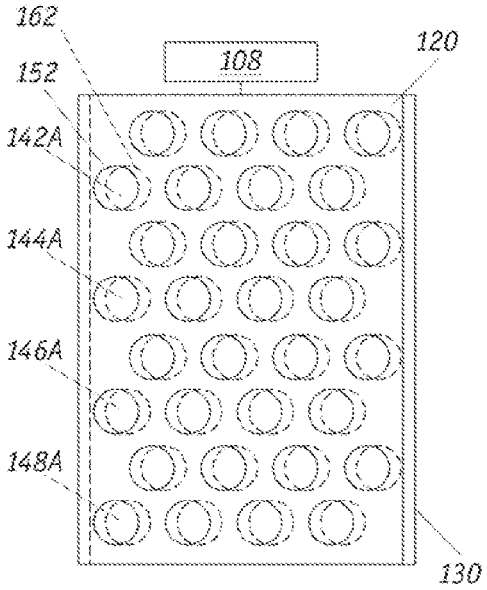

Lateral movement of exterior plate 120 relative to interior plate 130 shifts the positions of the apertures in exterior plate 120 relative to those in exterior plate 130 so as to reduce the size of the perforations in the screen plate as shown in FIG. 4C. For example, aperture 152 partially covers aperture 162 so that the area of perforation 142A is smaller than that of perforation 144 (FIG. 4B) when aperture 152 is fully aligned with corresponding aperture 162. In this fashion, the cross sectional area of each perforation (such as perforations 142A, 144A, 146A and 148A) in the screen plate 31 is adjusted to the same degree. Lateral movement of exterior plate 120 relative to interior plate 130 can be accomplished by moving one or both plates. As shown in FIGS. 4B and 4C, in this embodiment, the exterior plate 120 is connected to a precision manual or motorized displacement device 108. Suitable manual devices include screw mechanisms and suitable motorized devices include linear actuators. As further described herein, the effect of partially reducing the output area is to increase the steam jet velocity for a given steam volumetric flow into the discharge chamber.

Figure 5A:
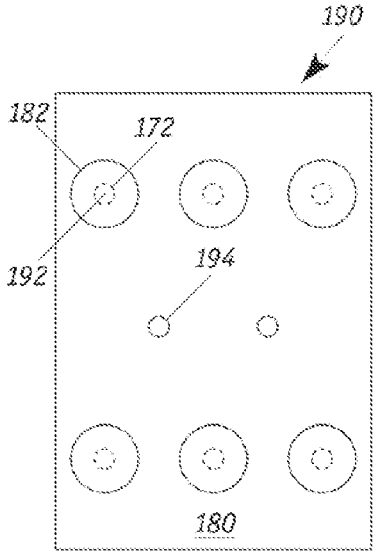
FIGS. 5A and 5B show the front views of a screen consisting of two plates with apertures of different sizes at two different alignment positions.
Figure 5B:
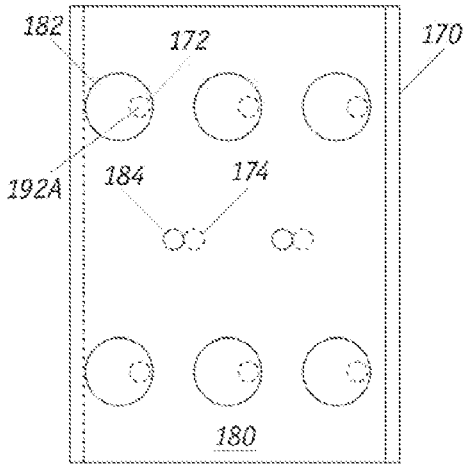

FIGS. 5A and 5B illustrate an embodiment of a screen plate 190 that includes exterior plate 180 and a lower interior plate 170 where the sizes of the apertures vary. Only three rows of perforations on the screen plate 190 are illustrated. In this construction, the circular apertures in the interior plate 170 all have the same diameter whereas the circular apertures in the first and third rows of exterior plate 180 are three times larger while the remaining apertures in the exterior have the same diameter as the apertures in the interior plate 170. As shown in FIG. 5A, when the apertures in the two plates are fully aligned, the output area of each screen plate perforation is restricted only by the size of the smaller interior apertures. In the top and third row of perforations, the larger apertures of the exterior plate 180 (such as aperture 182) are aligned with the smaller apertures in the interior plate 170 such as aperture 172). Thus, the output area for steam flow for perforation 182 is the same as the area of aperture 172. In the second row, because the size of the apertures in both plates is the same, the output area of the perforation 194 will also be the same. For this design, shifting of the exterior plate 180 relative to interior plate 170 effects the output areas of the first and second row perforations different than the output areas of the middle row perforations. For example, as shown in FIG. 5B, when the exterior plate 180 is moved a distance equal to the diameter of the smaller interior plate 170, the top row perforations retain the same output areas because the larger aperture 172 is sufficiently large to still fully expose the underlying smaller aperture 162. In contrast, the output areas of middle row perforations is effectively eliminated since the aperture 182 in the exterior plate and the aperture 172 in the interior plate are not align at all. The effect is to increase the jet velocity through the top and lower row perforations if the steam volumetric flow is the same, but no steam flows through the middle perforations as they are closed. As is apparently, if the exterior plate 180 is moved a distance of less than the diameter of the smaller interior plate 170, the output areas of the middle low perforations would be reduced thereby increasing the jet velocities in all of the perforations.

As is apparent, the shape, dimensions and arrangement of the apertures in the movable exterior and interior plates can be selected to create the desired steam output areas for the perforations in a screen that is formed. Indeed, while the screen plate is usually formed with two plates with apertures, additional plates can be used to provide additional features to the screen plate. Once the exterior and interior plates are slidably engaged, lateral movement of one or both plates changes the output area so as to modify the steam jet velocities of the steam exiting the perforations of the screen and impinging on the moving web.

Figure 6:
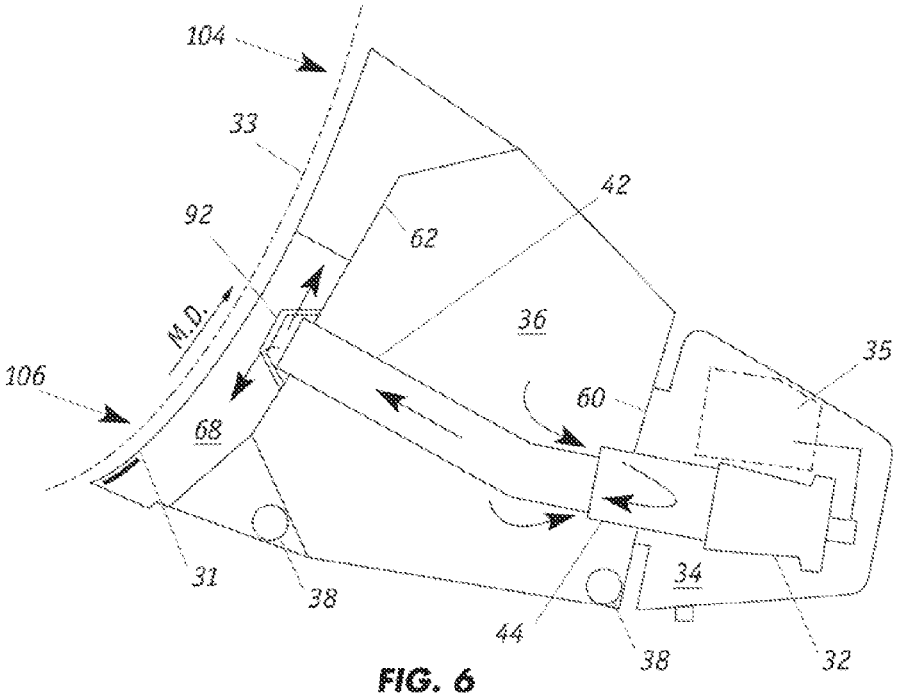
FIG. 6 is a cross sectional view of a compartment.
Figure 7A:
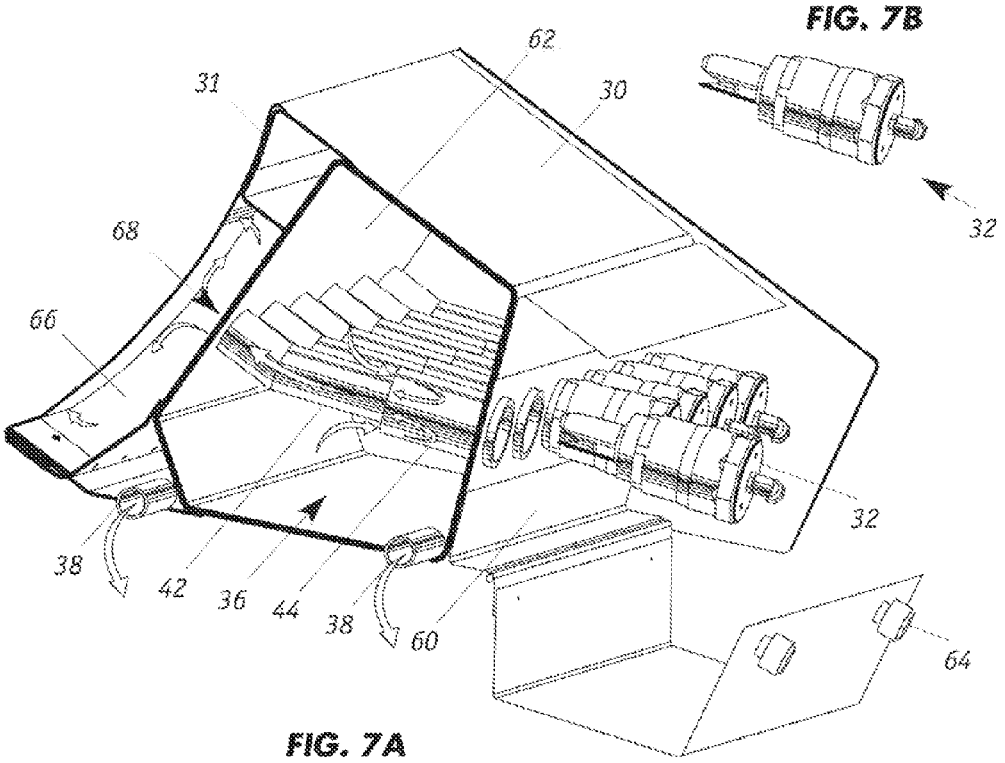
FIG. 7A is another perspective view of a compartment.

In operation of the steam box as shown in FIGS. 6 and 7A, high pressure steam that is supplied to the header 36 is drawn into the pipe 42 through the annular opening between the pipe 42 and the sleeve 44. The amount of steam drawn is controlled by the actuator 32 which is connected to a pneumatic supply 35 which tunes or regulates the actuator by pressurizing a diaphragm that is on top of a piston that is located inside the actuator 32. The piston is connected to a measuring plug that moves inside the sleeve 44 to control the amount of steam that goes into each discharge chamber. Steam from the pipe 42 initially enters into a discharge chamber 66 through the pipe outlet 68. The high velocity steam is dispersed within the discharge chamber 66 before exiting through the perforations of the from panel screen segment 31 and contacting a continuous moving sheet 33 located in front of the perforations. Preferably, a target plate 92 is positioned to disperse the high velocity steam uniformly throughout the discharge chamber 66 before the steam permeates through the perforations in the screen plate 31. In this fashion, there is uniform steam distribution from the leading edge 104 to the trailing edge 106 of the steam distribution apparatus as the sheet of material moves across the screen plate 31 in the machine direction. The speed at which moving sheet 33 determines the boundary layer velocity (or cross flow velocity), which is the velocity of the gaseous fluid flowing adjacent the moving sheet. Condensate that forms on the bottom of the discharge chamber 66 seeps through a drain hole and out through a condensate drain 38.

With respect to paper manufacturing, the desired or ideal steam velocity depends on, among other things, furnish (or paper pulp) composition, machine speed, and machine configuration. Steam velocities that are too low or excessively high degrade steam shower performance which result in reduced production, wasted steam and fiber build up in the steambox that in turn leads to sheet breaks, steam cloud, dripping and other problems. With the present invention, the steam jet velocity can be optimized to accommodate different paper production rates, paper grades and other criteria. Referring to FIG. 6, optimizing the jet velocity can takes into account various factors including, for example: (i) the distance (H) between screen 31 (equipped with the perforations) and moving sheet 33, (ii) output area (B) of the perforations; and (iii) boundary layer velocity. Typically, the H is between 0.125 to 0.5 in. (3.18 to 12.7 mm) and the boundary layer velocity is 300 to 7000 ft./sec. (91.4 to 2,134 m/sec.) For a particular paper production rate and grade, once H and the boundary layer velocity are established, the steam jet velocity can be optimized by adjusting the output area of the perforations. The jet velocity should range from 50 to 150 ft./sec. (15 to 45.7 m/sec.).

By monitoring and controlling the steam flow into each of the discharge chambers, the steam profile that is injected onto the sheet along its cross direction can be continuously and independently regulated. The steam profile as measured along the length of the steam distribution apparatus can be uniform or non-uniform so that the sheet or web of material can be exposed to a steam curtain having different steam velocities in the cross direction. Adjustment to the output areas of the perforations can be made in response to cross direction sensors, such as moisture profile sensors, located upstream and/or downstream of the steam distributor.

As shown in FIG. 2A, the front screen panel segment 31 has a concaved exterior contour. A backing bar 98 is secured to the lower end of the laterally spaced baffles 40. The front screen panel segment 31 can be welded onto a portion of the backing bar 98 as well as onto the baffles 40. In this fashion, the front screen panel segment 31 forms the front perforated wall of the steam discharge chambers. The front of the backing bar 98 also defines a series of dowel pins 84 that helps align the cleanout bar 48 as it is secured with screws 50 to the body of the steam distribution apparatus. When it is necessary to clean the steam discharge chambers between the baffles 40, it is only necessary to remove the cleaning bar 48 to gain access to the discharge chambers through access slots that are located at the lower end of each discharge chamber.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing, from the scope of the present invention as defined by the following claims.

What is claimed is:

1. An apparatus to distribute steam that comprises:

a steam distribution header;

a housing defining a steam discharge chamber that is in fluid communication with the steam distribution header;

a front screen that covers the steam discharge chamber and which has a plurality of perforations through which steam exits wherein the front screen comprises (i) a first plate that has a first set of apertures and (ii) a second plate that has a second set of apertures, wherein the second plate, which defines the exterior surface of the front screen, covers the first plate;

means for varying the size of at least one of the perforations through which steam exits wherein the means for varying the size of at least one of the perforations moves the second plate relative to the first plate in order to change the position of the first set of apertures relative to the second set of apertures; and means for regulating the flow of steam from the steam distribution header into the steam discharge chamber.

2. The apparatus of claim 1 wherein the second plate is tandem to the first plate and perforations in the front screen are formed by alignment of apertures in the first plate and to apertures in the second plate.

3. The apparatus of claim 2 wherein the size of each perforation ranges from 1.94 to 32.3 sq. mm in area.

4. The apparatus of claim 2 wherein one or more of the apertures in the first plate are not aligned with a corresponding aperture in the second plate so that one or more apertures in the first plate are covered and do not form perforations through which steam exits.

5. The apparatus of claim 1 wherein the first set of apertures forms a first pattern of apertures on the first plate and the second set of apertures forms a second pattern of apertures on the second plate and wherein the means for varying the size of at least one of the apertures changes the alignment to achieve a predetermined steam velocity through the perforations.

6. The apparatus of claim 5 wherein the predetermined steam velocity ranges from 15 to 46 m/sec.

7. The apparatus of claim 1 wherein the apparatus has a leading edge and a trailing edge relative to a sheet of that is moving in a machine direction wherein the housing comprises a plurality of oblique-oriented partition panels along the length of the housing to form a plurality of steam discharge chambers that are positioned along the length of the housing which is parallel to the cross direction, which is perpendicular to the machine direction, such that each oblique-oriented partition panel separates adjacent steam discharge chambers and the plurality of oblique-oriented partition panels are not aligned in the machine direction, wherein each steam discharge chamber is covered with a front screen that has a plurality of perforations through which steam exits and each second plate of the front screen has an exterior contour that is planar or that matches that of the moving sheet.

8. The apparatus of claim 1 wherein the front screen comprises a plurality of plates with each plate defining a set of apertures, wherein the plates are arranged in tandem and wherein the means for varying the size of at least one of the perforations moves the second plate so as to change the average steam velocity through the perforations.

9. The apparatus of claim 1 wherein the means for regulating the flow of steam from the steam distribution header into the steam discharge chamber maintains a constant flow of steam into the steam discharge chamber.

10. The apparatus of claim 1 wherein the means for varying the size of at least one of the perforations moves only the second plate in order to change the position of the first set of apertures relative to the second set of apertures.

11. The apparatus of claim 1 wherein the means for regulating the flow of steam comprises an actuator.

12. An apparatus to distribute steam which has a leading edge and a trailing edge relative to a sheet of that is moving in a machine direction, the apparatus comprising:

a housing comprises a plurality of oblique-oriented partition panels along the length of the housing to form a plurality of steam discharge chambers that are positioned along the length of the housing which is parallel to the cross direction, which is perpendicular to the machine direction, such that each oblique-oriented partition panel separates adjacent steam discharge chambers and the plurality of oblique-oriented partition panels are not aligned in the machine direction, wherein each steam discharge chamber is covered with a front screen that has a plurality of perforations through which steam exits and each front screen has an exterior contour that is planar or that matches that of the moving sheet:

a steam distribution header that is in fluid communication with the plurality of steam discharge chambers;

means for varying the size of at least one of the perforations through which steam exits in each front screen; and means for regulating the flow of steam from the steam distribution header into the plurality of steam discharge chambers.

13. The apparatus of claim 12 wherein each front screen comprises (i) a first plate that has a first set of apertures and (ii) a second plate that has a second set of apertures, wherein the second plate covers the first plate, and wherein the means for varying the size of at least one of the perforations moves the first plate, the second plate, or both the first and the second plates in order to change the position of the first set of apertures relative to the second set of apertures.

14. The apparatus of claim 13 wherein the second plate is tandem to the first plate and perforations in each front screen are formed by alignment of apertures in the first plate and to apertures in the second plate.

15. The apparatus of claim 14 wherein the size of each perforation ranges from 1.94 to 32.3 sq. mm in area.

16. The apparatus of claim 14 wherein one or more of the apertures in the first plate are not aligned with a corresponding aperture in the second plate so that one or more apertures in the first plate are covered and do not form perforations through which steam exits.

17. The apparatus of claim 13 wherein the first set of apertures forms a first pattern of apertures on the first plate and the second set of apertures forms a second pattern of apertures on the second plate and wherein the means for varying the size of at least one of the apertures changes the alignment to achieve a predetermined steam velocity through the perforations.

18. The apparatus of claim 17 wherein the predetermined steam velocity ranges from 15 to 46 m/sec.

19. The apparatus of claim 12 wherein the second plate of each front screen has an exterior contour that is planar or that matches that of the moving sheet.

20. The apparatus of claim 12 wherein each front screen comprises a plurality of plates with each plate defining a set of apertures, wherein the plates are arranged in tandem and wherein the means for varying the size of at least one of the perforations moves at least one of the plates so as to change the average steam velocity through the perforations.

* * * * *